US005795062A

United States Patent [19]

Johnson

[11] Patent Number: 5,795,062

[45] Date of Patent: Aug. 18, 1998

[54] MILKSHAKE MACHINE

[75] Inventor: Kevin M. Johnson, Natick, Mass.

[73] Assignee: Hamilton Beach/Proctor-Silex, Inc., Glen Allen, Va.

[21] Appl. No.: 724,771

[22] Filed: Oct. 3, 1996

[51] Int. Cl.[6] ..... B01F 15/02; B01F 7/26

[52] U.S. Cl. ..... 366/136; 366/137; 366/196; 366/307; 366/314; 366/317; 241/46.016; 241/97; 99/510; 99/340

[58] Field of Search ..... 366/136, 137, 366/279, 302, 307, 314, 315, 316, 317, 196; 241/46.016, 46.014, 46.013, 97, 80; 99/510, 348, 511

[56] References Cited

U.S. PATENT DOCUMENTS

| | | | |
|---|---|---|---|
| 1,570,920 | 1/1926 | Patelski . | |
| 1,766,999 | 6/1930 | Johnson | 366/317 |
| 1,854,087 | 4/1932 | Weckbaugh . | |
| 2,109,501 | 3/1938 | Osius . | |
| 2,302,138 | 11/1942 | Nicholson . | |
| 2,315,018 | 3/1943 | Lawrence . | |
| 2,322,058 | 6/1943 | Powers . | |
| 2,399,153 | 4/1946 | Wormeck et al. . | |
| 2,513,035 | 6/1950 | Lopata . | |
| 2,547,708 | 4/1951 | Kreiner . | |
| 2,583,997 | 1/1952 | Chester . | |
| 2,594,635 | 4/1952 | Gamaunt, Sr. . | |
| 2,842,320 | 7/1958 | Ewing . | |
| 2,879,949 | 3/1959 | Jordan . | |
| 3,085,756 | 4/1963 | Danforth et al. | 366/315 |
| 3,295,997 | 1/1967 | Tomlinson et al. . | |
| 3,809,325 | 5/1974 | Marrie . | |
| 4,030,707 | 6/1977 | Moreton . | |
| 4,275,848 | 6/1981 | Webb, Sr. . | |
| 4,299,501 | 11/1981 | Patil et al. | 366/136 |
| 4,496,244 | 1/1985 | Ludwing | 366/136 |
| 4,568,196 | 2/1986 | Hacheney . | |
| 4,745,773 | 5/1988 | Ando . | |
| 5,308,000 | 5/1994 | Riley . | |
| 5,340,036 | 8/1994 | Riley . | |
| 5,537,918 | 7/1996 | Patel et al. | 366/315 |

OTHER PUBLICATIONS

Submittal sheet and drawing showing Badger 1 1/3 HP garbage disposer, published by Emerson Electric Co., In-sink-Erator Division, Racine, Wisconsin, admitted to be prior art.

Sketch showing prior art drink mixing apparatus utilizing commercially-available waste disposer.

*Primary Examiner*—Tony G. Soohoo

*Attorney, Agent, or Firm*—Roger S. Dybvig

[57] ABSTRACT

A milkshake machine or similar apparatus uses the grinding and shredding principles employed by conventional impeller-type waster disposers. The milkshake machine has a housing that defines an upper grinding chamber and a lower receiving chamber separated by a rotatable impeller disk that mixes together and drives ingredients to be mixed against shredding surfaces on the inner wall of the grinding chamber. The receiving chamber has a discharge outlet, and a return inlet is provided in the housing above the grinding chamber. A discharge conduit is connected at one end to the discharge outlet at has a return port and a discharge spout at its opposite end. A return conduit is connected at one end to the return port of the discharge conduit and at its opposite end to the return inlet. A valve mechanism is provided to divert the mixed and ground ingredients expelled into the discharge conduit either into the return conduit and back into the grinding chamber or out of the discharge spout. The valve mechanism may be operated manually or by a solenoid or other suitable actuator, and a timer mechanism may be provided to toll the mixing cycle. A rinse inlet may also be provided in the housing to receive a cleaning solution on demand for cleaning the apparatus. The timer mechanism and the automatic valve mechanism may be used to control a cleaning or rinsing cycle.

20 Claims, 4 Drawing Sheets

MILKSHAKE MACHINE

FIELD OF THE INVENTION

This invention relates to apparatus, particularly milkshake machines, for mixing solids and liquids into a flowable mixture suitable for drinking.

BACKGROUND OF THE INVENTION

Conventional milkshake machines typically comprise a mixing blade or disk mounted on a rotating shaft. Ingredients to be mixed are placed in a separate mixing container, and the rotating shaft and blade are immersed in the ingredients. The container is routinely grasped by the operator and agitated and reciprocated relative to the shaft and blade, especially when hard-packed ice cream is used. This agitation may lead to hand injuries to the operator if the mixing blade pierces the container while it is grasped by the operator, which is especially likely if a paper or cardboard mixing container is used.

The mixing times of such conventional milkshake machines are vastly increased if hard-packed ice cream or any other hard ingredient is used in the milkshakes. Although improved milkshake machines have been developed in an attempt to overcome the lengthened mixing time caused by the use of hard-packed ice cream, these improved milkshake machines still require several seconds to satisfactorily mix a milkshake made from hard-packed ice cream. Examples of such improved milkshake machines are found in U.S. Pat. Nos. 5,150,967, 5,328,263, and 5,439,289, which disclose machines that provide automated reciprocal movement of the mixing blade into and out of the mixing cup.

Other known milkshake machines use mixing principles that differ from the rotatable shaft and blade concept discussed above. For example, the machine shown in U.S. Pat. No. 1,854,087 employs a rotor element rotating in close proximity to a stator element so as to develop a centrifugal action which draws down and mixes the liquid and solid ingredients and subjects them to the disruptive action of the closely-spaced rotating surfaces. Ingredients to be mixed are placed in a hopper above the rotor element and, upon mixing, are subsequently discharged into a cup removably mounted beneath the rotor element. This closely rotating rotor/stator configuration and its underlying principles are similar, although not identical, to the configuration and underlying grinding and shredding principles employed by conventional, commercially-available impeller-type waste disposers.

SUMMARY OF THE INVENTION

The primary object of this invention is to provide a milkshake machine or similar apparatus for mixing solids and liquids into a flowable mixture suitable for drinking that is capable of satisfactorily mixing the ingredients, regardless of their original consistency, in only a few seconds.

Another object of this invention is to provide a milkshake machine or similar apparatus in which the operator is not exposed or potentially exposed to the mixing components as the milkshake is being mixed. A related object is to provide a milkshake machine or similar apparatus wherein the ingredients are not mixed in a mixing container separate or detached from the rest of the apparatus.

Still another object of this invention is to provide a milkshake machine or similar apparatus that has a simple and inexpensive construction, is easily operated, and is easily cleaned and maintained.

In accordance with this invention, a milkshake machine or similar apparatus uses the grinding and shredding principles employed by a conventional, commercially-available impeller-type waste disposer to mix, comminute, and pulverize the ingredients of a milkshake. The apparatus comprises a housing having an upper opening for receiving ingredients to be mixed and a return inlet. The housing defines both an upper grinding chamber having a cylindrical inner wall with a plurality of shredding surfaces and a lower receiving chamber located beneath the grinding chamber having a discharge outlet. A discharge conduit is connected at one end to the discharge outlet and has a return port and a discharge spout at its opposite end. A return conduit is connected at one end to the return port of the discharge conduit and at its opposite end to the return inlet.

A rotatable impeller disk is located within the housing and separates the grinding chamber and the receiving chamber. A suitable motor drives the impeller disk so that its peripheral margin rotates in close proximity to the shredding surfaces on the inner wall of the grinding chamber, thereby defining a circumferential discharge gap between the periphery of the impeller disk and the inner wall of the grinding chamber. The impeller disk has a plurality of impellers mounted thereon near its periphery. As the impeller disk is rotated, the ingredients in the grinding chamber are mixed together and centrifugally driven by the impellers against the shredding surfaces on the inner wall of the grinding chamber. The mixed and ground or comminuted ingredients pass through the discharge gap into the receiving chamber and are expelled through the discharge outlet into the discharge conduit.

A valve mechanism is provided between the return port and the discharge spout of the discharge conduit and includes a diverter movable between a return position and a discharge position. With the diverter in the return position, ingredients expelled into the discharge conduit are diverted through the return port into the return conduit and returned to the grinding chamber for further processing. With the diverter in the discharge position, ingredients expelled into the discharge conduit are diverted out of the discharge spout and into an awaiting container such as a paper cup.

The diverter may be moved manually or the valve mechanism may include an actuator for moving the diverter. An optional timer may be used to toll the mixing cycle. In addition, the timer may be set or programmed to toll mixing cycles of various duration. The timer may also be set or programmed to control a cleaning or rinsing cycle whereby a cleaning liquid is automatically supplied to the apparatus through a rinse inlet in the housing, circulated through the apparatus, and discharged through the discharge spout. To prevent splashing during operation, a removable imperforate lid is preferably used to cover the upper opening in the housing.

DETAILED DESCRIPTION

Figure 1:
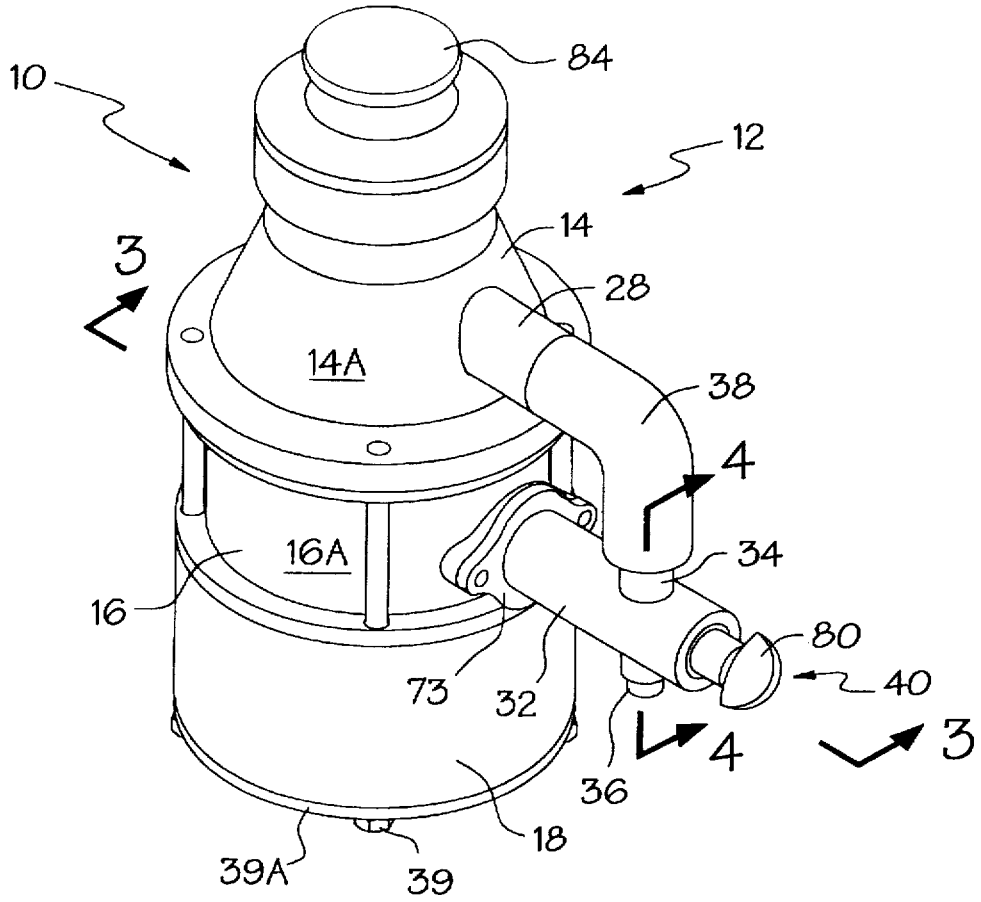
FIG. 1 is a perspective view of an apparatus in accordance with this invention for mixing solids and liquids into a flowable mixture suitable for drinking. It will be noted that the illustrated apparatus is intended primarily for use as a milkshake machine, but an apparatus in accordance with this invention may be used to mix other types of ingredients.
Figure 2:
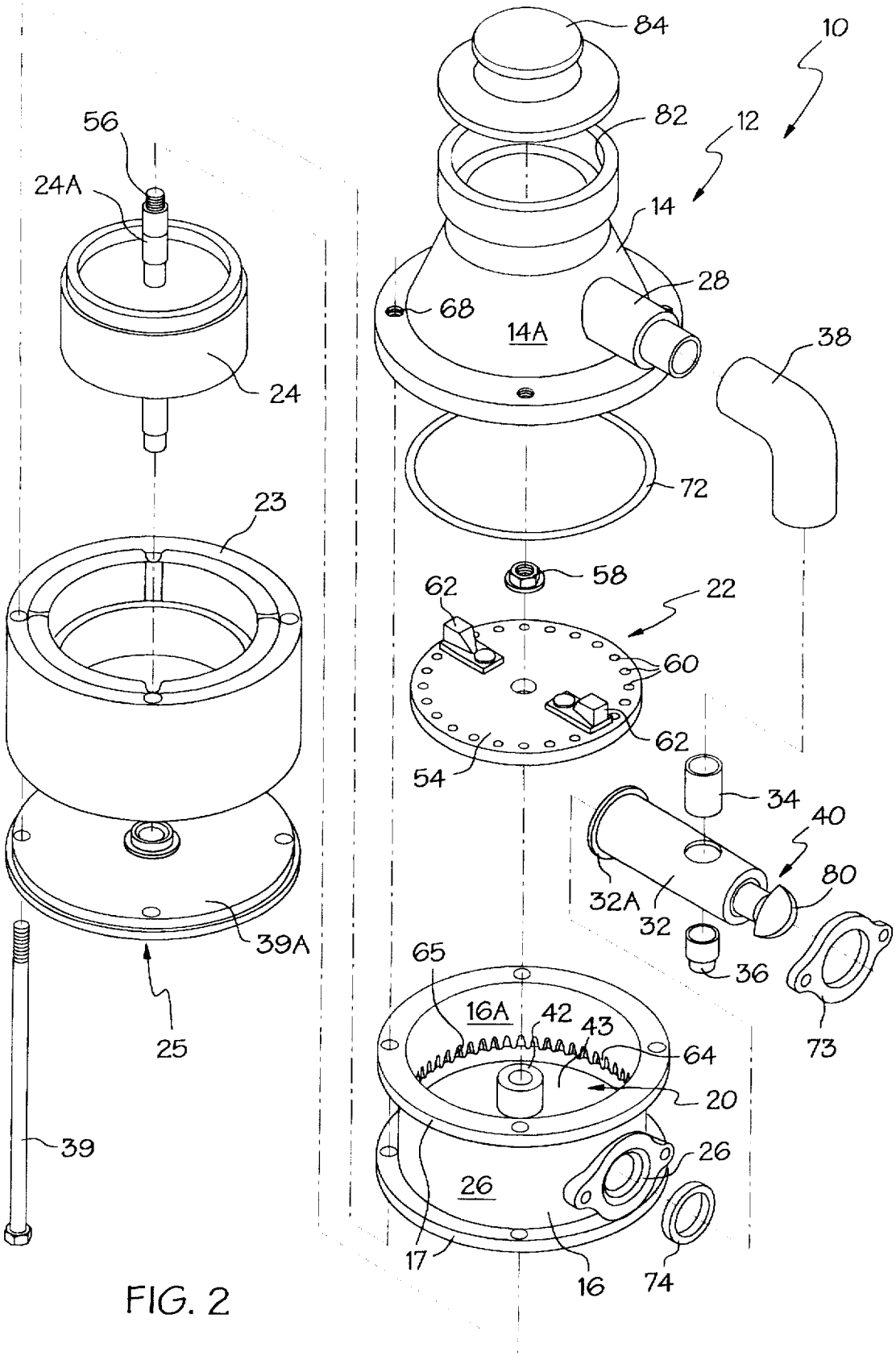
FIG. 2 is an exploded, perspective view of the apparatus of FIG. 1.
Figure 3:
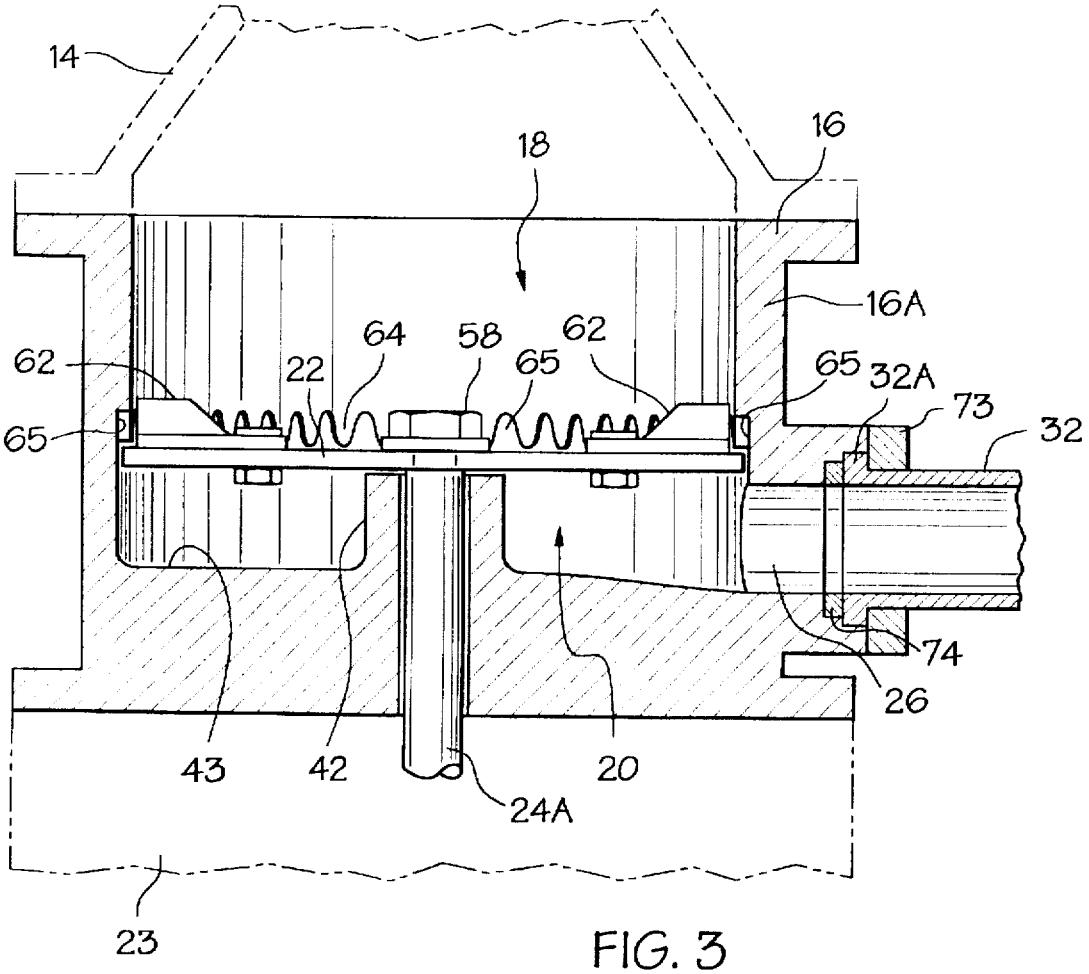
FIG. 3 is a fragmentary, sectional view, with parts shown in phantom lines, of a portion of the apparatus of FIG. 1 taken along lines 3—3 thereof.

With reference to FIGS. 1 and 2, a milkshake machine or similar apparatus in accordance with this invention, generally designated 10, uses the grinding and shredding principles employed by commercially-available impeller-type waste disposers to mix, comminute, and pulverize the milkshake ingredients. The apparatus 10 comprises a housing, generally designated 12, formed from a generally conical upper housing 14 and a generally cylindrical lower housing 16. With reference also to FIG. 3, the housing 12 defines a cylindrical upper grinding chamber 18 and a lower receiving chamber 20 separated by a impeller disk 22. A stator 23 is secured to the bottom of the lower housing 16 and houses a conventional electric motor armature or rotor assembly 24 having a shaft 24A, thereby forming a drive motor assembly generally designated 25.

A discharge outlet 26 is formed in the wall 16A of the lower housing 16 opening from the receiving chamber 20. Similarly, a return inlet 28 is formed in the wall 14A of the upper housing 14 above the grinding chamber 18. A discharge conduit 32 is connected at one end to the discharge outlet 26 and has a return port 34 and a discharge port or spout 36 at its opposite end. A return conduit 38 is connected at one end to the return port 34 and at its opposite to the to the return inlet 28. A valve mechanism, generally designated 40, is disposed between the return port 34 and the discharge spout 36 to control the path of ingredients in the discharge conduit 32.

Generally, the grinding and shredding principles employed by the instant invention are commonly employed by conventional, commercially-available impeller-type waste disposers, such as waste disposers manufactured by Emerson Electric Co., In-Sink-Erator Division, of Racine, Wis. For purposes of this invention, grinding and shredding capabilities equivalent to a ⅓ horsepower disposer are considered sufficient for the applications described herein. In this respect, a known ⅓ horsepower disposer has a 4⅛ cup grinding chamber and an impeller disk speed of 1725 RPM. Other examples of conventional impeller-type disposer using such grinding shredding principles are found in U.S. Pat. Nos. 2,322,058, 2,842,320, and 2,879,949, the disclosures of which are hereby incorporated herein by reference.

One skilled in the art will recognize that the components of the apparatus 10 which contact the milkshake ingredients must be made from high quality, food grade material in order to be acceptable for household or commercial food preparation. In addition, a suitable external vanity housing (not shown) is preferably used to enhance the outward appearance of the apparatus 10. The vanity housing may include suitable sound-insulating material (not shown) to reduce the noise level of the apparatus 10 when in use.

With reference to FIG. 2, the illustrated stator 23 is connected to the upper housing 14 and the lower housing 16 by four bolts 39, only one of which is shown in FIG. 2, but it will be understood that other motor configurations not so connected to the upper housing 14 and the lower housing 16 may be used. The lower housing 16 has a hollow, cylindrical hub 42 projecting upwardly from the floor 43 thereof through which the shaft 24A of the rotor 24 extends into the grinding chamber 18. The bolts 39 extend through a lower cover plate 39A covering to the bottom of the stator 18, through apertures 41 in the stator 18, through apertures 17A in the upper and lower flanges 17 of the lower housing 16, and into tapped bores 68 in the upper housing 14.

With reference also to FIG. 3, the impeller disk 22 is drivingly secured to the threaded upper end 56 of the rotor shaft 24A by a mounting nut 58. Consequently, the impeller disk 22 will rotate with the shaft 24A. Of course, one skilled in the art will recognize that suitable bearings, thrust washers, and the like (not shown) will also be used in the connection of the impeller disk 22 to the rotor shaft 24A. In addition, it is preferable to provide a suitable flexible seal (not shown) around the shaft 24A of the rotor 24 to prevent liquid within the grinding chamber 18 from passing through the hub 42 and damaging the motor assembly 25.

The impeller disk 22 is so sized and located that the peripheral margin of the impeller disk 22 will rotate in close proximity to the inner wall surface 16A of the lower housing 16. However, the impeller disk 22 does not contact the wall surface 16A so that a circumferential discharge gap 61 remains between the impeller disk 22 and the inner wall surface 16A of the lower housing 16. The impeller disk 22 has a plurality of small openings or drains 60 that permit air, liquid, and small particles to pass through the impeller disk 22 from the grinding chamber 18 to the receiving chamber 20. In addition, the impeller disk 22 has a pair of diametrically-opposed impellers 62 mounted near its periphery, the details of which are not critical to an understanding of this invention. Therefore, impellers configured other than the impellers 62 shown in FIGS. 2 and 3 may be used. The illustrated impellers 62 are pivotally or rotatably mounted on the impeller disk 22 to swivel 360 degrees with respect to the disk 22, thereby reducing the likelihood of jams, which is a feature also commonly found in commercially-available impeller-type waste disposers.

Upon actuation of the motor assembly 25, the impeller disk 22 is rotated and the impellers 62 centrifugally swirl the ingredients in the grinding chamber 18. The swirling ingredients are mixed together and centrifugally forced against teeth-like shredding/grinding surfaces 64 formed on the inner wall 16A of the grinding chamber 18, which shredding/grinding surfaces 64 define recesses 65 that open to the discharge gap 61. The ingredients are repeatedly forced against the shredding/grinding surfaces 64 until sufficiently reduced to a size to create a flowable mixture which can pass through the discharge gap 61 between the periphery of the impeller disk 22 and the inner wall surface 16A of the lower housing 16 (or through the drains 60 in the impeller disk 22). The shredding/grinding surfaces 64 may be formed by a shredding/grinding ring (not shown) separate from the lower housing 16, as common in conventional, impeller-type waste disposer, or the shredding/grinding surfaces 64 may be formed as an integral part of the lower housing 16. Once the ingredients are sufficiently reduced in size and pass into the receiving chamber 20, they are centrifugally expelled through the discharge outlet 26 by additional impellers or paddles (not shown) on the bottom surface of the impeller disk 22, such as shown and described in U.S. Pat. No. 5,340,036, although other suitable constructions may be used to expel the ground ingredients.

The apparatus 10 is assembled by mounting the upper housing 14 atop the lower housing 16 to form the housing 12, which is connected to the drive motor assembly 25. The upper housing 14 has four tapped bores 68 aligned with the apertures 17A in the flanges 17 of the lower housing 16, which are in turn aligned with corresponding apertures 41 in the stator 18. The bolts 39 pass through the apertures 41 and 17A and the threaded upper ends thereof are received in the tapped bores 68 in the upper housing 14 to secure the lower cover plate 39A, the stator 18, the lower housing 16, and the upper housing 14 together. A rubber O-ring 72 is disposed between the upper housing 14 and the lower housing 16 to provide a liquid-tight seal at the junction therebetween.

As briefly described above and further in accordance with this invention, the discharge conduit 32, which has an annular flange 32A, is connected to the discharge outlet 26 by a retainer 73 secured to the lower housing 16 by a pair of screws 75 (FIG. 3). A gasket 74 provides a liquid-tight seal between the discharge outlet 24 and the discharge conduit 32. The discharge conduit 32 may comprise a horizontally-extending pipe or tube which is preferably formed from plastic or other material suitable for food handling, and the downwardly-facing discharge spout 36 is located at the end of the discharge conduit 32 remote from the discharge outlet 26. The upwardly facing return port 34 is provided in the discharge conduit diametrically opposite the discharge spout 36, but could be at any other suitable location relative to the discharge spout 36. The return conduit 38, which may be a rubber hose, is connected at one end to the return port 34 in a suitable manner, such as by a conventional hose fitting (not shown), and leads to the return inlet 28 in the upper housing 14.

Figure 4:
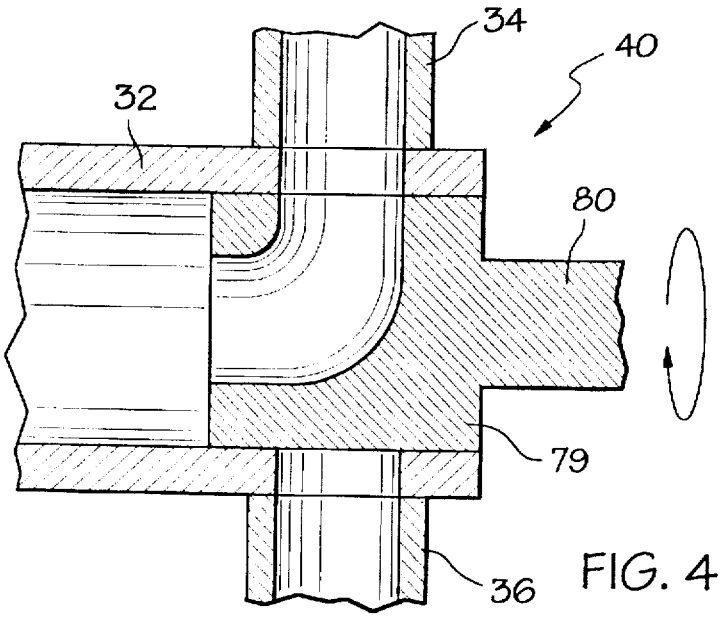
FIG. 4 is a simplified, fragmentary sectional view of a portion of the apparatus of FIG. 1 taken along lines 4—4 thereof.

With reference also to FIG. 4, a suitable valve mechanism 40 is disposed at the free end of the discharge conduit 32 between the return port 34 and the discharge spout 36 of the discharge conduit 32 to control the path of mixed and ground ingredients discharged through the discharge outlet 26 and into the discharge conduit 32. Although the details of the valve mechanism 40 are not crucial to an understanding of this invention and other valve configurations may be used, the valve mechanism 40 may be a typical ball valve having a stop-cock or diverter 79 movable between a discharge position wherein the ground ingredients are discharged out of the spout 36 and a return position, shown in FIG. 4, wherein the ground ingredients are diverted through the return port 34 and pass through the return conduit 38 back into the grinding chamber 18 through the return inlet 28. The diverter 79 may be moved between the discharge position and the return position by use of a handle 80 drivingly connected to the diverter 79.

In operation of the apparatus 10, ingredients to be mixed, such as hard-packed ice cream, milk, flavoring, nuts, cookies, candies, etc., are placed in the grinding chamber 18 through an opening 82 in the upper housing 14. Thereafter, an imperforate lid 84 is preferably placed over the opening 82 by the operator to prevent splashing. With the diverter 79 in the return position, the drive motor assembly 25 is activated for a short period of time, perhaps as little as 1 to 3 seconds, after which time the valve mechanism 40 is actuated to move the diverter 79 to the discharge position. Accordingly, the mixed and ground ingredients are then discharged out of the spout 36 and into a container (not shown) located beneath the spout 36. Of course, the necessary mixing time will depend upon the nature of the ingredients used and the preference of the user as to consistency.

Figure 5:
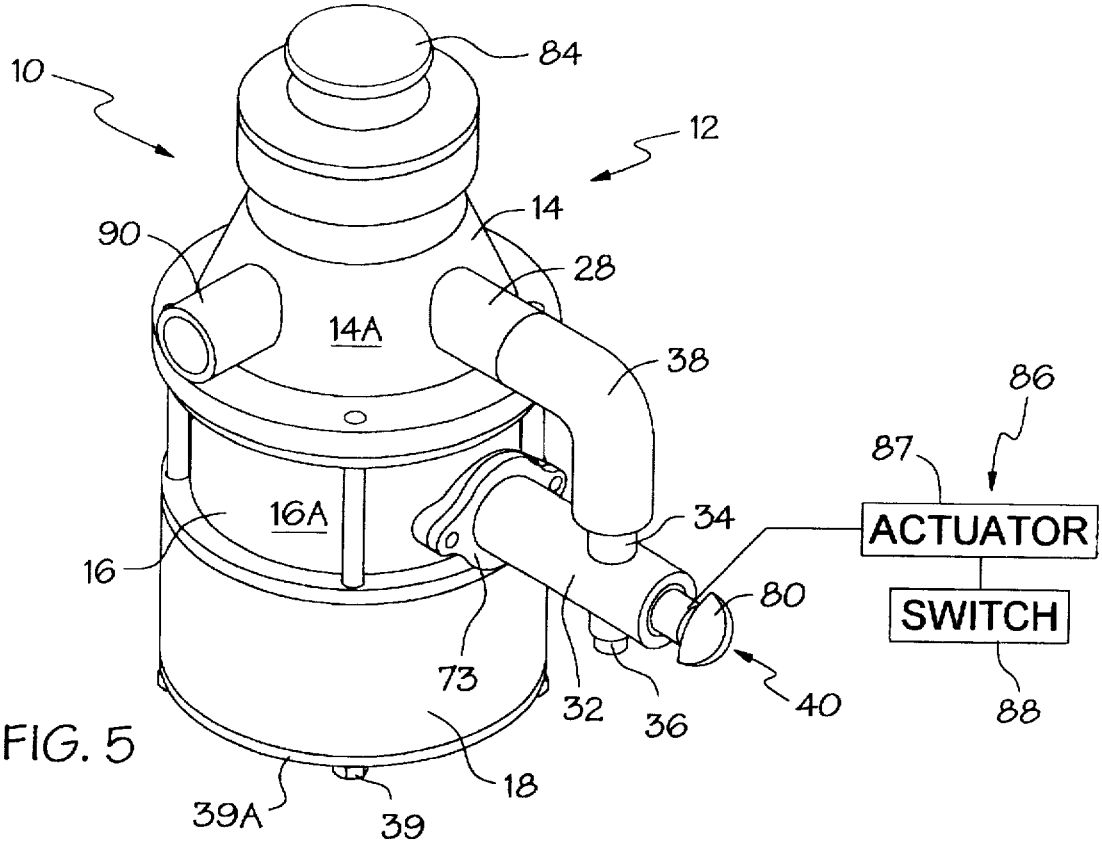
FIGS. 5 and 6 are partially-schematic perspective views similar to FIG. 1, but showing further embodiments of the apparatus of FIG. 1.

The embodiment shown in FIGS. 1 and 2 has a manually-operable valve mechanism 40. However, it is contemplated that other embodiments of the apparatus in accordance with this invention may use a solenoid-operated or other suitable automatic valve mechanism, generally designated 86, as shown partially schematically in FIG. 5. In the embodiment of FIG. 5, a solenoid or other suitable actuator 87 is used to move the diverter 79 between the return position and the discharge position. A control switch 88 could be used to control the apparatus 10 so that mixing begins when the switch 88 is actuated and the actuator 87 moves the diverter 79 to the discharge position when the switch is released. A slight delay after the switch 88 is released before the drive motor assembly 25 is disengaged may be useful to expel the mixed ingredients through the discharge spout 36.

Figure 6:
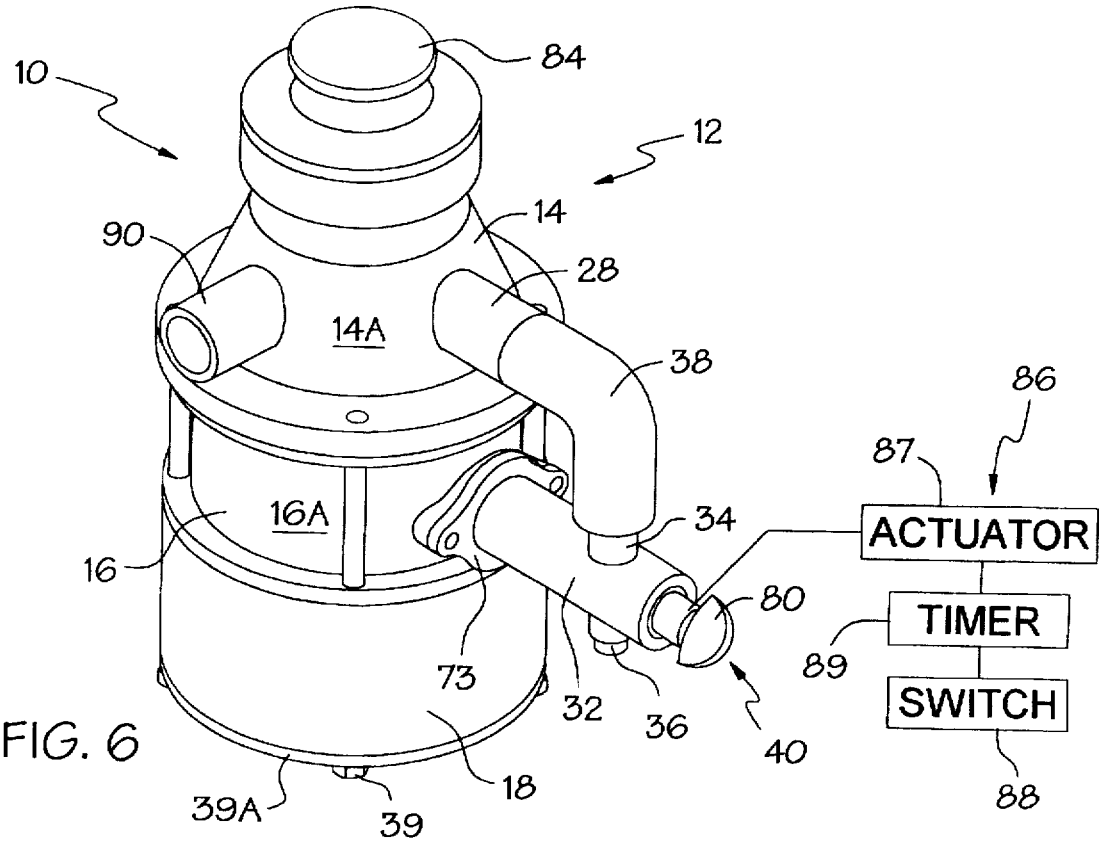

FIG. 6 illustrates a more complex embodiment utilizing a suitable timer mechanism 89, which may be an electronic timer or a mechanical timer, to control the operation of the automatic valve mechanism 86, and thereby the duration of the mixing cycle. A timer mechanism 89 that is user-adjustable to toll various time periods would provide a user with the ability to vary the duration of the mixing cycle, depending on the nature of the ingredients used for the milkshake. For example, the timer mechanism 89 could be set or programmed for a short time period of 1 to 3 seconds for mixing typical milkshakes, but a longer cycle could be set or programmed for cleaning purposes, as will be described below. The timer mechanism 89 could, however, simply be used to sound or emit a bell, buzzer, or other alarm signal to notify the operate that the mixing cycle is complete and that the diverter 79 should be moved to the discharge position.

Although the details of the foregoing automatic valve mechanism 86 and the timer mechanism 89 are not discussed further herein, it will be recognized that such details would be readily available to one having ordinary skill in the art.

With continued reference to FIGS. 5 and 6, the apparatus 10 may also include a rinse inlet 90 for receiving rinse water or a cleaning solution. The rinse inlet 90 may be configured in a manner similar to the return inlet 28. It is contemplated that the rinse inlet 90 will be connected to a source of water or a cleaning solution, or both, that can be supplied on demand to the apparatus 10 for cleaning purposes. In this respect, it is further contemplated that the controls discussed above, namely the automatic valve mechanism 86 and the timer 89, may be set or programmed to operate a cleaning or rinsing cycle.

During a cleaning or rinsing cycle, a predetermined amount of water or a cleaning solution is automatically supplied to the apparatus 10 through the rinse inlet 90. (One skilled in the art will recognize that a suitable valve mechanism will likely be used to regulate or control the supply of water or cleaning solution.) The water or cleaning solution is circulated throughout the apparatus 10 for a specified cleaning cycle to clean the working parts of the apparatus 10. At the expiration of the cleaning cycle, the water or cleaning solution is discharged from the spout 36. If a detergent-based cleaning solution is used, a rinse cycle consisting of only water might be desirable to wash away any detergent residue from the initial cleaning cycle. Thus, an operator could clean the apparatus 10 by actuating a control switch, for example, to initiate a cleaning and/or rinsing cycle, as described above. The details of the specific controls for automatically providing a cleaning or rinsing cycle are not discussed further herein, as such details would be readily available to one skilled in the art.

One skilled in the art will recognize that the apparatus illustrated in FIGS. 1 through 6 without vanity shields are similar in appearance to a conventional, commercially-available impeller-type waste disposer. However, such illustration is used primarily for purposes of describing the invention. Preferably, an apparatus 10 in accordance with this invention is not amodified disposer as described above. Instead, it is preferable to specifically construct the apparatus 10 as a milkshake machine that merely utilizes the grinding and shredding principles employed by conventional, commercially-available impeller-type waste disposers as described above.

In addition to constructing the apparatus 10 as described above to use the grinding and shredding principles employed by conventional, commercially-available impeller-type waste disposer, a milkshake machine or similar apparatus may also be constructed by simply modifying a conventional, commercially-available impeller-type waste disposer. The modifications would include the addition of the discharge conduit 32, the return conduit 38, and the valve mechanism 40, as described above, with the return conduit 38 leading from the discharge conduit 32 to a dishwasher drain inlet commonly found in commercially-available disposers. However, such a modified disposer would not be generally acceptable for sale as a commercial or household food preparation appliance without replacing the components that contact the ingredients with food grade replacements. Moreover, a milkshake machine or similar apparatus constructed simply from a modified waste disposer would substantially retain its appearance as a disposer, which would not ordinarily encourage use in food preparation. Still, a modified waste disposer would satisfactorily achieve the aforementioned objects of this invention.

Although the presently preferred embodiments of this invention have been described, it will be understood that within the purview of the invention various changes may be made within the scope of the following claims.

Having thus described my invention, I claim:

1. A conventional, commercially-available impeller-type waste disposer modified to be an apparatus, such as a milkshake machine, for mixing solids and liquids into a flowable mixture suitable for drinking, said disposer comprising (a) a housing having an upper opening for receiving ingredients to be ground into a flowable mixture and a dishwasher drain inlet, said housing defining both an upper chamber having a cylindrical inner wall with a plurality of shredding surfaces and a lower chamber located beneath the upper chamber and having a discharge outlet, (b) a rotatable impeller disk disposed within said housing separating the upper chamber and the lower chamber, said impeller disk having its peripheral margin rotating in close proximity to the inner wall of the upper chamber and defining a discharge gap therebetween, said impeller disk further having a plurality of impellers mounted thereon near the periphery thereof such that, as said impeller disk is rotated, the ingredients in the upper chamber are mixed together and driven against the shredding surfaces on the inner wall of the upper chamber, pass through the discharge gap into the lower chamber, and are expelled through the discharge outlet, and (c) a motor for rotating the impeller disk, wherein said modifications comprise:

a discharge conduit connected at one end to the discharge outlet and having a return port and a discharge spout at its opposite end;

a return conduit connected at one end to the return port of the discharge conduit and at its opposite end to the dishwasher drain inlet; and a valve mechanism intermediate the return port and the discharge spout of said discharge conduit, said valve mechanism having a diverter movable between a return position wherein ingredients expelled into said discharge conduit are diverted through said return port into said return conduit and returned to the upper chamber for further processing and a discharge position wherein ingredients expelled into said discharge conduit are diverted out of the discharge spout.

2. The modified disposer of claim 1 wherein the diverter is moved manually from the return position to the discharge position.

3. The modified disposer of claim 1 wherein said modifications further comprise a timer for tolling a mixing cycle.

4. The modified disposer of claim 1 wherein said valve mechanism includes an actuator for moving the diverter from the return position to the discharge position.

5. The modified disposer of claim 4 wherein said modifications further comprise a timer for tolling a mixing cycle, and wherein the actuator of said valve mechanism is responsive to said timer to move the diverter from the return position to the discharge position.

6. The modified disposer of claim 5 wherein said timer is programmable to toll mixing cycles of various durations.

7. The modified disposer of claim 4 wherein said modifications further comprise a control switch, and wherein the actuator is responsive to said control switch to move the diverter from the return position to the discharge position.

8. The modified disposer of claim 1 wherein said modifications further include a rinse inlet formed in said housing.

9. The modified disposer of claim 8 wherein said valve mechanism includes an actuator for moving the diverter from the return position to the discharge position and a timer for tolling a cleaning cycle, wherein the actuator of said valve mechanism is responsive to said timer to move the diverter from the return position to the discharge position, and wherein the modifications further comprise a control switch for initiating a cleaning cycle whereby a cleaning liquid is supplied to the apparatus through said rinse inlet, circulated through said apparatus with said diverter in the return position, and discharged through said discharge spout at the end of the cleaning cycle.

10. The modified disposer of claim 1 wherein said modifications further comprise a removable imperforate lid covering the upper opening in said housing.

11. An apparatus, such as a milkshake machine, for mixing solids and liquids into a flowable mixture suitable for drinking, comprising:

a housing having an upper opening for receiving ingredients to be mixed and a return inlet, said housing defining both an upper chamber having a cylindrical inner wall with a plurality of shredding surfaces and a lower chamber located beneath the upper chamber and having a discharge outlet;

a discharge conduit connected at one end to the discharge outlet and having a return port and a discharge spout at its opposite end;

a return conduit connected at one end to the return port of said discharge conduit and at its opposite end to the return inlet;

a rotatable impeller disk disposed within said housing separating the upper chamber and the lower chamber, said impeller disk having its peripheral margin rotating in close proximity to the shredding surfaces on the inner wall of the upper chamber and defining a discharge gap therebetween, said impeller disk further having a plurality of impellers mounted thereon near the periphery thereof such that, as said impeller disk is rotated, the ingredients in the upper chamber are mixed together and driven against the shredding surfaces on the inner wall of the upper chamber, pass through the discharge gap into the lower chamber, and are expelled through the discharge outlet into said discharge conduit;

a motor for rotating the impeller disk; and a valve mechanism intermediate the return port and the discharge spout of the discharge conduit, said valve mechanism having a diverter movable between a return position wherein ingredients expelled into said discharge conduit are diverted through the return port into said return conduit and returned to the upper chamber for further processing and a discharge position wherein ingredients expelled into said discharge conduit are diverted out of the discharge spout.

12. The apparatus of claim 11 wherein the diverter is moved manually from the return position to the discharge position.

13. The apparatus of claim 11 further comprising a timer for tolling a mixing cycle.

14. The apparatus of claim 11 wherein said valve mechanism includes an actuator for moving the diverter from the return position to the discharge position.

15. The apparatus of claim 14 further comprising a timer for tolling a mixing cycle, and wherein the actuator of said valve mechanism is responsive to said timer to move the diverter from the return position to the discharge position.

16. The apparatus of claim 15 wherein said timer is programmable to toll mixing cycles of various durations.

17. The apparatus of claim 14 further comprising a control switch, and wherein the actuator is responsive to said control switch to move the diverter from the return position to the discharge position.

18. The apparatus of claim 11 wherein said housing has a rinse inlet.

19. The apparatus of claim 18 wherein said valve mechanism includes an actuator for moving the diverter from the return position to the discharge position and a timer for tolling a cleaning cycle, wherein the actuator of said valve mechanism is responsive to said timer to move the diverter from the return position to the discharge position, and wherein the apparatus further comprises a control switch for initiating a cleaning cycle whereby a cleaning liquid is supplied to the apparatus through said rinse inlet, circulated through said apparatus with said diverter in the return position, and discharged through said discharge spout at the end of the cleaning cycle.

20. The apparatus of claim 11 further comprising a removable imperforate lid covering the upper opening in said housing.

* * * * *